United States Patent [19]

Roberts

[11] Patent Number: 4,484,253

[45] Date of Patent: Nov. 20, 1984

[54] POCKET FLASHLIGHT

[76] Inventor: Irving J. Roberts, 19 Breeze Hill Rd., East Hampton, N.Y. 11937

[21] Appl. No.: 535,732

[22] Filed: Sep. 26, 1983

[51] Int. Cl.[3] ..... F21L 7/00

[52] U.S. Cl. ..... 362/206; 200/60; 362/204; 362/205; 362/295

[58] Field of Search ..... 362/204, 205, 206, 295; 200/60

[56] References Cited

U.S. PATENT DOCUMENTS

| | | | |
|---|---|---|---|
| 1,408,526 | 3/1922 | Lyhne | 362/206 |
| 2,666,894 | 1/1954 | Babernitsh | 362/206 |
| 3,742,207 | 6/1973 | Strauss | 362/206 |
| 4,281,368 | 7/1981 | Humbert | 362/206 |
| 4,408,263 | 10/1983 | Sternlicht | 362/206 |

*Primary Examiner*—Stephen J. Lechert, Jr.

*Attorney, Agent, or Firm*—Gottlieb, Rackman & Reisman

[57] ABSTRACT

A pocket flashlight, which may be disposable, is disclosed. The flashlight includes a tube-like body, preferably formed of plastic or other non-conductive material, which is adapted to receive at least one flashlight battery and a flashlight bulb. The flashlight includes a conventional pushbutton mechanism which selectively activates the flashlight bulb. A spring member, located within the flashlight body, is provided for completing an electrical circuit when the pushbutton mechanism is depressed. The spring member, formed of metal or other conductive material, includes a helical spring and a relatively narrow spring leg, the latter fitting within a channel formed in the flashlight body, in order to complete the electrical circuit when the pushbutton mechanism is depressed.

9 Claims, 8 Drawing Figures

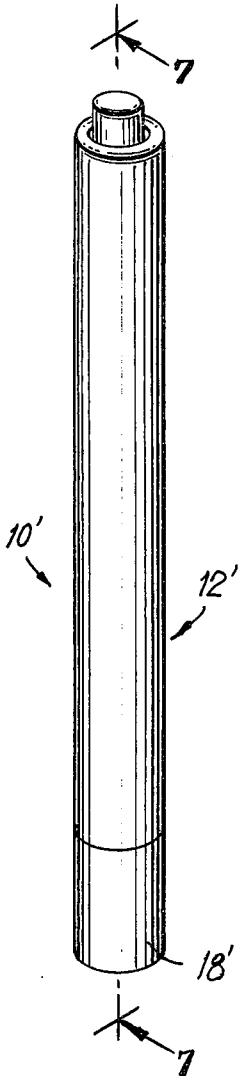
FIG.7
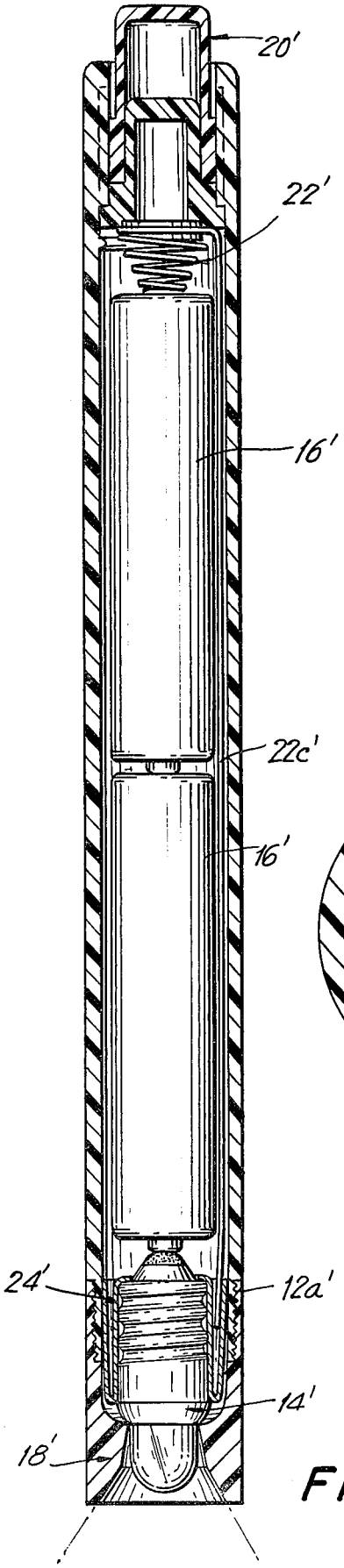
FIG.8
FIG.6
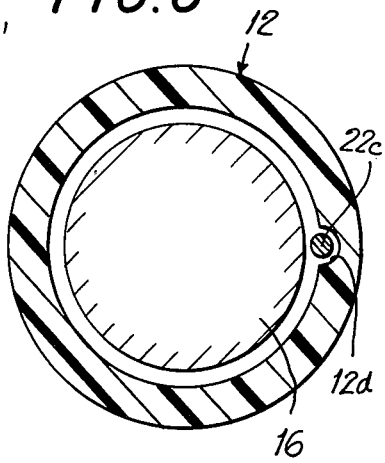

POCKET FLASHLIGHT

DESCRIPTION

This invention relates generally to flashlights and, more particularly, to a pocket flashlight having a pushbutton actuating mechanism of the protract-retract type.

There is an important need in the art for a pocket flashlight of improved construction and characteristics. On the one hand, the flashlight should have replaceable batteries and a replaceable bulb, so as to provide long use as well as conservation of materials. On the other hand, the flashlight should be relatively inexpensive, so that it can be disposable as is sometimes required, for example, when the flashlight is used in the medical field. In either case, the flashlight should be relatively simple to operate and relatively inexpensive to manufacture.

There are several prior art flashlight constructions, but none of these meet all of the above-recited requirements. For example, one common flashlight construction utilizes a plastic tube as the flashlight body. This pocket flashlight has a "clip switch" which has to be depressed constantly in order to complete the circuit between the battery and the bulb. Thus, this switch must be depressed, and kept depressed, in order to keep the flashlight "on". Furthermore, this flashlight is not "refillable", that is, neither the bulb nor batteries can be replaced.

In order to provide a pocket flashlight which is simple to operate, it is desirable that the flashlight use a conventional pushbutton mechanism of the protract-retract type used in ball point pens, as the mechanism which turns the flashlight on or off. There have been several attempts to use such a mechanism with pocket flashlights. However, they have been less than desirable for several reasons. One such flashlight using a conventional protract-retract ball point pen type switch mechanism is manufactured under the trademark Kwik-Lite by Island Pen Company, Brooklyn, N.Y. This flashlight uses a metal cylindrical body and further utilizes helical springs located at both ends of the flashlight battery; that is, the flashlight utilizes a spring located between the flashlight bulb and the anode of the battery and another helical spring located between the cathode of the battery and the protract-retract ball point pen type switch mechanism. The fact that the body is metal and that two springs are required increases manufacturing costs. Furthermore, the battery must be uncoated exposing its metal casing in order for this flashlight to operate properly. Since such batteries are not commercially available, they are supplied with the flashlight or else must be specially prepared by the flashlight user.

Yet another pocket flashlight utilizing a conventional protract-retract ball point pen type switch mechanism is manufactured by Union Carbide under the Eveready trademark. Although this flashlight can utilize coated batteries, it must use a metal flashlight body since it is this metal casing which completes the battery/bulb circuit for the flashlight when the ball point type switch mechanism is actuated. This flashlight is also expensive to manufacture since it requires a metal body for proper operation.

Accordingly, it is a broad object of the present invention to provide an improved pocket flashlight.

A more specific object of the present invention is to provide a pocket flashlight which is simple to operate yet relatively inexpensive to manufacture.

Yet another object of the present invention is to provide a pocket flashlight which is refillable, yet inexpensive enough to manufacture and sell at retail so as to be disposable.

These and other objects of the present invention are obtained by providing a pocket flashlight having a flashlight body formed of a non-conductive material, preferably plastic. The flashlight body is adapted to receive at least one flashlight battery and a flashlight bulb. The flashlight is turned on and/or off by a pushbutton mechanism, of the protract-retract type use in ball point pens. A spring member formed of a conductive material is also located within the flashlight body. The spring member completes an electrical circuit from the flashlight battery to the flashlight bulb when the pushbutton mechanism is depressed. The spring member includes a helical spring which is depressed by the pushbutton mechanism. The spring member also includes a spring leg, which travels within a channel defined in the flashlight body, to make contact with the flashlight bulb, via a metal collar located around the bulb, when the pushbutton mechanism is depressed. A retainer cap is included in order to retain the pushbutton mechanism, spring member, battery and bulb in position within the flashlight body. In accordance with one embodiment of the invention, the retainer cap is located adjacent to the pushbutton mechanism. In an alternative, second embodiment, the retainer cap is located adjacent to the flashlight bulb.

Further objects, features and advantages of the invention will become apparent upon consideration of the following detailed description of preferred, but nontheless illustrative embodiments, when considered in conjunction with the following drawings, in which:

FIG. 6 is a sectional view, enlarged in scale, taken along the line 6—6 of FIG. 4;

FIG. 7 is a front perspective view of second, alternative embodiment according to the invention; and FIG. 8 is a sectional view, taken along the line 7—7 of FIG. 7 but enlarged in scale, showing the flashlight in an "on" condition.

Figure 1:
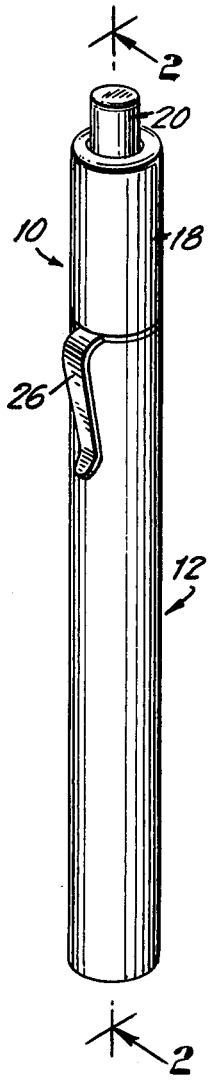
FIG. 1 is a front perspective view of a pocket flashlight according to a first embodiment of the present invention.

Referring to the drawings and, more particularly, to FIGS. 1-6 thereof, a pocket flashlight according to the present invention is generally designated 10. The flashlight 10 includes a tube-like, cylindrical body or case 12 formed, preferably, of a non-conductive material such as a molded plastic. One end of the cylindrical body is threaded at **12*a* while the other end of the cylindrical body defines a shoulder 12*b* and an aperture 12*c*. The shoulder 12*b* acts as an abutment for a flashlight bulb 14** of conventional design. The bulb includes a metal body portion 14a which is partially threaded, a battery receiving portion 14b, and a glass or other transparent portion 14c which fits through aperture 12c of flashlight body 12 so that the bulb can "shine" out of the flashlight when the bulb is energized. In order to provide a source of energey for the bulb, the flashlight body 12 receives conventional flashlight batteries 16.

Flashlight 10 also includes a retainer cap 18 which is threaded at end 18a and which has an aperture at end 18b. Threaded end 18a cooperates with the threaded end 12a of the flashlight body so that the retainer cap can be threadedly secured to the flashlight body 12.

The retainer cap 18 receives a conventional pushbutton switch mechanism 20. The pushbutton mechanism is of the protract-retract type commonly used in ball point pen mechanisms, and disclosed, for example, in U.S. Pat. No. 3,137,276, issued June 16, 1964 to K. Weisser. Suffice to say that the pushbutton mechanism 20 is usually in one of three positions. In the first position, illustrated in FIG. 2, the pushbutton mechanism is in its retracted position and, as will be explained, in this position the flashlight is an "off" condition. In the second position, illustrated in FIG. 3, the pushbutton mechanism 20 has been depressed (for exmaple by the finger pressure of a user) to its fullest extent, and the flashlight has entered its "on" condition. In the third position, illustrated in FIG. 4, finger pressure has been removed and the pushbutton mechanism has retracted slightly, with the flashlight remaining in its "on" condition. Subsequent finger pressure applied to the pushbutton mechanism when in the position illustrated in FIG. 4 depresses the pushbutton mechanism and subsequent release causes the pushbutton mechanism to assume the position illustrated in FIG. 2. As is known, the internal "button" of mechanism 20 rotates as the mechanism is depressed.

The flashlight also includes a spring member 22 having a helical spring portion 22a, a cylindrical disk-shaped portion 22b and a cylindrical finger-like leg portion 22c. The leg portion 22c of spring member 22 is adapted to ride within a channel 12d defined within the flashlight body 12 (see FIG. 6). Preferably, channel 12d extends within the body a distance equal to approximately the length of the batteries 16. The channel 12d functions to guide the leg 22c in a longitudinal direction relative to flashlight body 12 as the pushbutton mechanism is actuated. In particular, the channel prevents the leg from twisting as the pushbutton mechanism is actuated and also prevents the spring leg from being "pinched" against the flashlight wall by batteries 16. It will be appreciated that twisting of the spring leg or having it pinched between the flashlight body and the batteries would adversely affect the operation of the flashlight. The disk portion 22b of the spring member further prevents twisting of the spring leg when the pushbutton mechanism is actuated since the pushbutton mechanism, which turns as it is operated, slides on the disk thereby reducing the twisting force applied to the spring member 22.

In order to provide "positive" and continuous contact between the spring leg and bulb when the pushbutton mechanim is depressed, the flashlight preferably includes a metal bulb collar 24 which fits around the bulb body 14a and which defines a generally U-shaped channel about the bulb body. The bulb collar is configured to define an aperture 24a (see FIG. 5) which enables the battery receiving portion 14b of the bulb to extend out of the collar. The U-shaped channel is defined by cylindrical walls 24b and 24c, the former sized to form a relatively tight fit about the bulb body 14a and the latter flarred somewhat outwardly (see FIG. 2). Thus, the U-shaped channel, defined by the walls 24b and 24c, is tapered somewhat in order to facilitate receipt of the end 22c of spring member 22. The bulb collar 24 is provided since the bulb 14 is frequently narrower in diameter than the diameter of the batteries 16 and the inner diameter of the flashlight body 12. The bulb collar accordingly provides contact between the bulb and leg enabling the leg 22c of the spring member to complete the battery circuit when the pushbutton mechanism is depressed. If the bulb collar is not provided, there is the chance that the leg 22c would not make contact or would make only intermittent contact with the bulb body 14a when the pushbutton mechanism is depressed, resulting in faulty operation of the flashlight.

For convenience purposes, flashlight 10 may include a clip 26 which can slip over the threaded end 12a of the flashlight body 12 to be held in place by the retainer cap 18.

In a typical loading operation, the flashlight is loaded by placing the bulb collar 24 over the bulb 14 and by placing this combination into the cylindrical body 12 of the flashlight. Batteries 16 are then inserted, followed by spring member 22. The spring member is positioned such that the leg 22c is disposed within the channel 12d of the flashlight body. The clip 26 is placed about the cylindrical body. The retainer cap 18, which has previously received the pushbutton mechanism 20, is then threaded to the cylindrical body, the retaining cap maintaining all of the elements in place.

Figure 2:
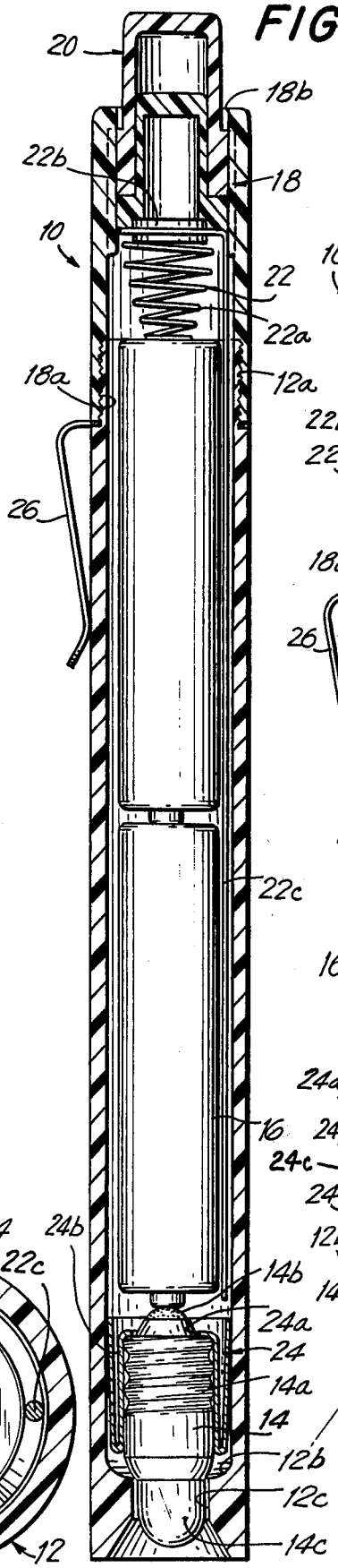
FIG. 2 is a sectional view, enlarged in scale, taken along the line 2—2 of FIG. 1 and showing the flashlight in an "off" condition.
Figure 3:
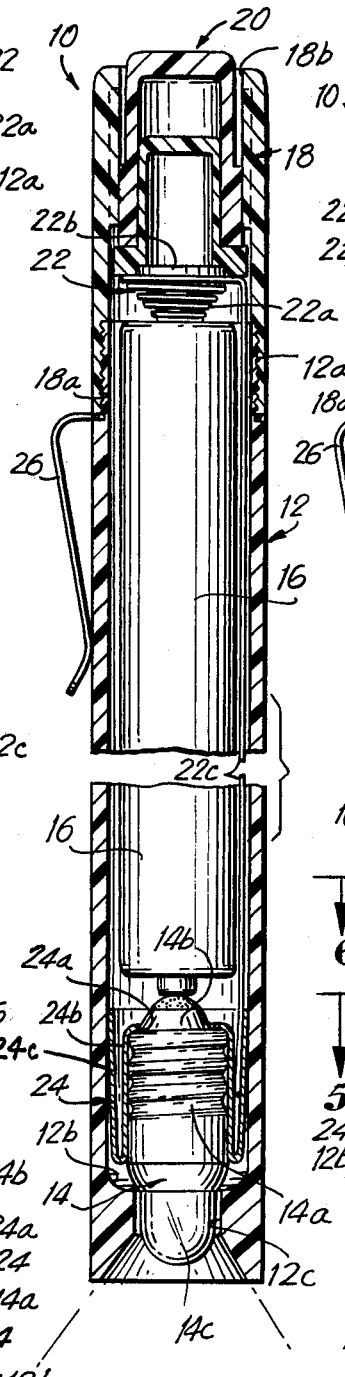
FIG. 3 is a sectional view, similar to that of FIG. 2, but showing the pushbutton mechanism fully depressed so that the flashlight is in an "on" condition.
Figure 4:
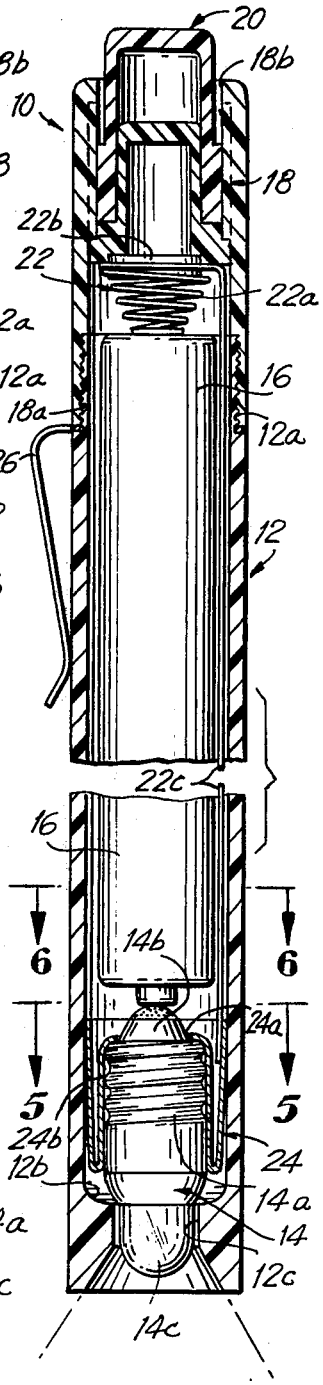
FIG. 4 is a sectional view, similar to that of FIG. 2, showing the pushbutton mechanism in an intermediate position with the flashlight maintained in an "on" condition.
Figure 5:
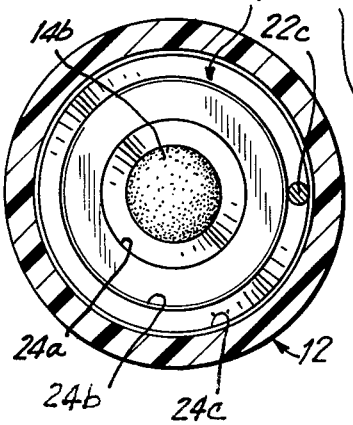
FIG. 5 is a sectional view, enlarged in scale, taken along the line 5—5 of FIG. 4.

The flashlight is in its normally off condition, shown in FIG. 2, when the pushbutton mechanism is in its fully retracted (or non-depressed) position. In this position, the leg 22c of the spring member does not make contact with the bulb collar 24; the helical spring portion 22a serving to bias leg 22b toward the "pushbutton" end of the flashlight. In order to operate the flashlight, that is, in order to turn it "on", the pushbutton mechanism is fully depressed, as illustrated in FIG. 3. This compresses the helical portion 22a of the spring member 22 and, in turn, the leg 22c of the spring member slides toward bulb 14, with the end of the leg being received by the U-shaped channel of the bulb collar 24 and completing the circuit thereby energizing the bulb. When the pushbutton mechanism is released, the mechanism allows the helical portion 22a to partially decompress which, in turn, causes the leg of the spring member to partially slide back. However, as illustrated in FIG. 4, the leg 22c continues to make contact with the bulb collar 24 and the light 14 remains on. When the pushbutton mechanism is depressed again, the mechanism returns to the position shown in FIG. 2 resulting in the deenergization of the bulb since the leg 22c breaks contact with the metal bulb collar 24.

It should be noted that the channel 12d in which the leg 22c is allowed to slide serves to guide the leg so as to prevent the leg from being twisted or from being pinched by the batteries so that the leg moves in an unimpeded up and down fashion in response to the pushbutton mechanism. Furthermore, the bulb collar 24 serves to make firm contact with the end of the leg 22c in order to provide a sure contact with the bulb. Finally, the flashlight body, which advantageously is formed of plastic, can be fabricated relatively inexpensively thereby enabling the flashlight to be disposable, if desired, yet refillable, if also desired, from a cost standpoint.

FIGS. 7 and 8 illustrate an alternative, second embodiment of the invention. In this embodiment, the flashlight 10' has a cylindrical body 12', a pushbutton mechanism 20' and a bulb 14' energized by batteries 16' when the pushbutton mechanism is depressed by virtue of the leg 22c' of spring member 22' making contact with bulb collar 24'. In the embodiment illustrated in FIGS. 7 and 8, however, the flashlight is loaded from its bottom end so that the retaining cap 18' screws onto the threaded end 12a' of the cylindrical body adjacent the bulb. A clip (not shown) may be provided, with the clip having appropriate prongs which can be pressed into the side of the cylindrical body during manufacture of the flashlight.

Flashlight 10' operates in substantially the same fashion as the flashlight disclosed in the first embodiment previously described.

It will be appreciated that numerous modifications may be possible in light of the above teachings. Accordingly, the above description is by way of example only, and modifications, changes and the like are contemplated within the scope of the invention which is set forth in the following claims.

I claim:

1. A flashlight comprising:

a non-conductive flashlight body adapted to receive at least one flashlight battery having a non-conductive coating and adapted to receive a flashlight bulb;

a protract-retract pushbutton mechanism movable from a fully retracted condition, to a fully depressed condition, to a partially retracted condition, back to its fully retracted condition for selectively energizing said flashlight bulb; and a spring member located within said flashlight body and including a spring leg movable in a first longitudinal direction generally parallel to the longitudinal axis of said flashlight body to a first position wherein said spring leg initially completes an electrical circuit from said flashlight battery to said flashlight bulb thereby energizing said bulb when said pushbutton mechanism is actuated and is moved from its fully retracted condition to its fully depressed condition, said spring leg movable in a second longitudinal direction generally parallel to the longitudinal axis of said flashlight body to a second position wherein said spring leg continues to complete an electrical circuit from said flashlight battery to said flashlight bulb thereby energizing said bulb without continuous pressure being applied by a user to said pushbutton mechanism when said pushbutton mechanism is released and is moved from its fully depressed condition to its partially retracted condition, said spring leg movable in said first longitudinal direction and subsequently in said second longitudinal direction to a third position wherein said spring leg moves out of electric contact with said flashlight bulb thereby breaking the electrical circuit from said flashlight battery to said flashlight bulb to deenergize said bulb when said pushbutton mechanism is depressed and is moved from its partially retracted condition to its fully retracted condition.

2. A flashlight according to claim 1 wherein said spring member further includes a helical spring for normally biasing said spring leg in a position so as not to complete said electrical circuit, said spring leg being biased to be out of electrical contact with said flashlight bulb.

3. A flashlight according to claim 2 wherein said flashlight body includes a channel, said spring leg being positioned to slide within said channel in said longitudinal directions as said pushbutton mechanism is actuated.

4. A flashlight according to claim 3 further including a collar for receiving an end of said spring leg thereby completing said electrical circuit to said electrical bulb when said pushbutton mechanism is actuated.

5. A flashlight according to claim 1 wherein said spring member further includes a disk-shaped portion adapted to cooperate with said protract-retract mechanism in order to inhibit twisting of said spring leg when said pushbutton mechanism is actuated.

6. A flashlight according to claim 5 further including a retainer cap for maintaining said bulb, said battery, said spring member and said pushbutton mechanism in place within said flashlight body.

7. A flashlight according to claim 6 wherein said retainer cap is located adjacent to said pushbutton mechanism.

8. A flashlight according to claim 6 wherein said retainer cap is located adjacent to said bulb.

9. A flashlight according to claim 1 wherein said flashlight body is formed of a plastic material.

* * * * *